US009463636B2

(12) United States Patent
Koda et al.

(10) Patent No.: US 9,463,636 B2
(45) Date of Patent: Oct. 11, 2016

(54) FLOW PATH MEMBER, LIQUID EJECTING HEAD, AND LIQUID EJECTING APPARATUS

(71) Applicant: SEIKO EPSON CORPORATION, Tokyo (JP)

(72) Inventors: Takafumi Koda, Matsumoto (JP); Taiki Hanagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/733,408

(22) Filed: Jun. 8, 2015

(65) Prior Publication Data

US 2015/0367649 A1 Dec. 24, 2015

(30) Foreign Application Priority Data

Jun. 24, 2014 (JP) ..... 2014-128892

(51) Int. Cl.
*B41J 2/20* (2006.01)
*B41J 2/175* (2006.01)

(52) U.S. Cl.
CPC ..... *B41J 2/20* (2013.01); *B41J 2/1752* (2013.01); *B41J 2/17523* (2013.01); *B41J 2/17553* (2013.01)

(58) Field of Classification Search
None
See application file for complete search history.

(56) References Cited

U.S. PATENT DOCUMENTS 6,390,611 B1 * 5/2002 Kobayashi ..... B41J 2/175 347/84
2009/0027449 A1 * 1/2009 Silva ..... B41J 2/155 347/47
2014/0063137 A1 * 3/2014 Tsukahara ..... B41J 2/1752 347/85

FOREIGN PATENT DOCUMENTS

JP 2014-000717 A 1/2014

* cited by examiner

*Primary Examiner* — Bradley Thies
(74) *Attorney, Agent, or Firm* — Workman Nydegger

(57) ABSTRACT

There is provided a flow path member including a flow-path member main body which is provided with a liquid supplying path through which liquid is supplied to a head main body that ejects liquid and an attaching portion to which a liquid supplying unit that supplies liquid of the liquid supplying path is attached; and a sealing member which is provided with an insertion hole into which the attaching portion is inserted, and is interposed between the liquid supplying unit and the attaching portion, in which a convex portion is provided in any one of the inner surface of the insertion hole and the outer surface of the attaching portion, and a concave portion that fits with the convex portion is provided in the other of the inner surface of the insertion hole and the outer surface of the attaching portion.

20 Claims, 10 Drawing Sheets

FLOW PATH MEMBER, LIQUID EJECTING HEAD, AND LIQUID EJECTING APPARATUS

CROSS-REFERENCE TO RELATED APPLICATIONS

The present application claims priority to Japanese Patent Application No. 2014-128892 filed on Jun. 24, 2014, which is hereby incorporated by reference in its entirety.

BACKGROUND

1. Technical Field

The present invention relates to a flow path member that supplies liquid to a head main body ejecting the liquid, a liquid ejecting head that includes the flow path member, and a liquid ejecting apparatus that includes the liquid ejecting head.

2. Related Art

As a representative example of a liquid ejecting head that ejects liquid, there is an ink jet type recording head that ejects ink droplets. As the ink jet type recording head, there is proposed, for example, a recording head including a head main body that ejects ink droplets from a nozzle opening, and a flow path member in which the head main body is fixed, and a liquid storage unit such as an ink cartridge that stores ink therein is provided in a detachable manner, and which supplies the ink from the liquid storage unit to the head main body (for example, JP-A-2014-000717).

The flow path member includes an attaching portion of which a filter that is in a liquid-plane contact with the liquid storage unit is provided at a tip, and a sealing member that is provided around the attaching portion and seals the connection between the liquid storage unit and the filter.

However, if the sealing member rotates around the attaching portion and thus a positional deviation occurs, the sealing member cannot be uniformly deformed, and thus a deviation occurs in deformation of the sealing member. Therefore an adhesion defect occurs, and thus a problem of leakage of ink arises.

In addition, a liquid supplying unit is connected to the filter so that a contact area gradually increases from one side of the filter toward the other side in an in-plane direction. Therefore the outer shape of the attaching portion is made to have a so-called oval shape, in which a line connecting the one side and the other side is longer than a line orthogonal to the line connecting the one side and the other side, such as an ellipse, an oval, or an egg shape, so as to cause uniform stress to be applied thereto at the time of connection. In a case where the outer shape is other than the oval shape, that is, other than circular, the deviation of the deformation due to the positional deviation in a rotating direction easily occurs.

Further, similarly, such a problem exists not only in the ink jet type recording head but also in the flow path member used in the liquid ejecting head that ejects liquid other than ink.

SUMMARY

An advantage of some aspects of the invention is to provide a flow path member, a liquid ejecting head, and a liquid ejecting apparatus in which leakage of liquid due to an adhesion defect is suppressed.

According to a first aspect of the invention, there is provided a flow path member including a flow-path member main body provided with a liquid supplying path through which liquid is supplied to a head main body that ejects liquid and an attaching portion to which a liquid supplying unit that supplies liquid of the liquid supplying path is attached; and a sealing member provided with an insertion hole into which the attaching portion is inserted, and is interposed between the liquid supplying unit and the attaching portion, in which a convex portion is provided in any one of the inner surface of the insertion hole and the outer surface of the attaching portion, and a concave portion that fits with the convex portion is provided in the other of the inner surface of the insertion hole and the outer surface of the attaching portion.

In this aspect, the positioning of the sealing member with respect to the attaching portion can be performed by causing the convex portion to fit with the concave portion, it is possible to improve the assemblability, and it is possible to suppress a deformation defect due to a positional deviation of the sealing member with respect to the attaching portion. In addition, when a load is applied to the sealing member, such as a case of attachment of the liquid supplying unit, the movement of the sealing member in a rotating direction with respect to the attaching portion can be regulated by the fitting of the convex portion and the concave portion. Accordingly, it is possible to suppress a deformation defect due to a positional deviation of the sealing member. Further, by the fitting of the convex portion and the concave portion, it is possible to increase the contact area between the sealing member and the attaching portion and to improve adhesiveness by an anchor effect. Further, by providing the convex portion and the concave portion on the inner surface of the sealing member and the outer surface of the attaching portion, it is possible to decrease the size of the sealing member and the size of the flow path member compared to a case in which the convex portion is provided on the outer surface of the sealing member.

Here, the sealing member may include a base portion that is provided with the insertion hole, and a first lip that extends from the base portion to the liquid supplying unit to be in contact therewith. According to this, the base portion in which the concave portion is provided and the first lip that performs sealing by being in contact with the liquid supplying unit can be disposed apart from each other, and it is possible to suppress a deformation defect of the first lip by providing the concave portion.

Further, the sealing member may further include a second lip that is in contact with the flow-path member main body. According to this, the base portion in which the concave portion is provided and the second lip that performs sealing by being in contact with the flow-path member main body can be disposed apart from each other, and it is possible to suppress a deformation defect of the second lip by providing the concave portion.

In addition, the convex portion may be provided on the outer surface of the attaching portion, and the concave portion may be provided on the inner surface of the insertion hole. According to this, it is possible to achieve size reduction.

In addition, when the sealing member is viewed from a point of the liquid supplying path extending toward the liquid supplying unit, the outer shape of the sealing member may have a longitudinal direction and a short direction. According to this, when the liquid supplying unit is mounted along the longitudinal direction, since a load of the liquid supplying unit with respect to the sealing member is gradually increased, it is possible to suppress a deformation defect due to a drastic change of the load with respect to the sealing member.

In addition, each of angles formed by three surfaces of the concave portion corresponding to the convex portion may be an acute angle. According to this, when the convex portion fits with the concave portion, in addition to a force of the concave portion for interposing the convex portion, the engagement of the concave portion and convex portion is further strengthened, and therefore it is possible to suppress a positional deviation in the rotating direction.

Further, according to a second aspect of the invention, there is provided a liquid ejecting head including the flow path member of the first aspect.

In this aspect, a liquid ejecting head in which the leakage of liquid is suppressed, and thus the reliability is enhanced can be implemented.

Further, according to a third aspect of the invention, there is provided a liquid ejecting apparatus including the flow path member of the first aspect or the liquid ejecting head of the second aspect.

In this aspect, a liquid ejecting apparatus in which the leakage of liquid is suppressed, and thus the reliability is enhanced can be implemented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

First Embodiment

Figure 1:
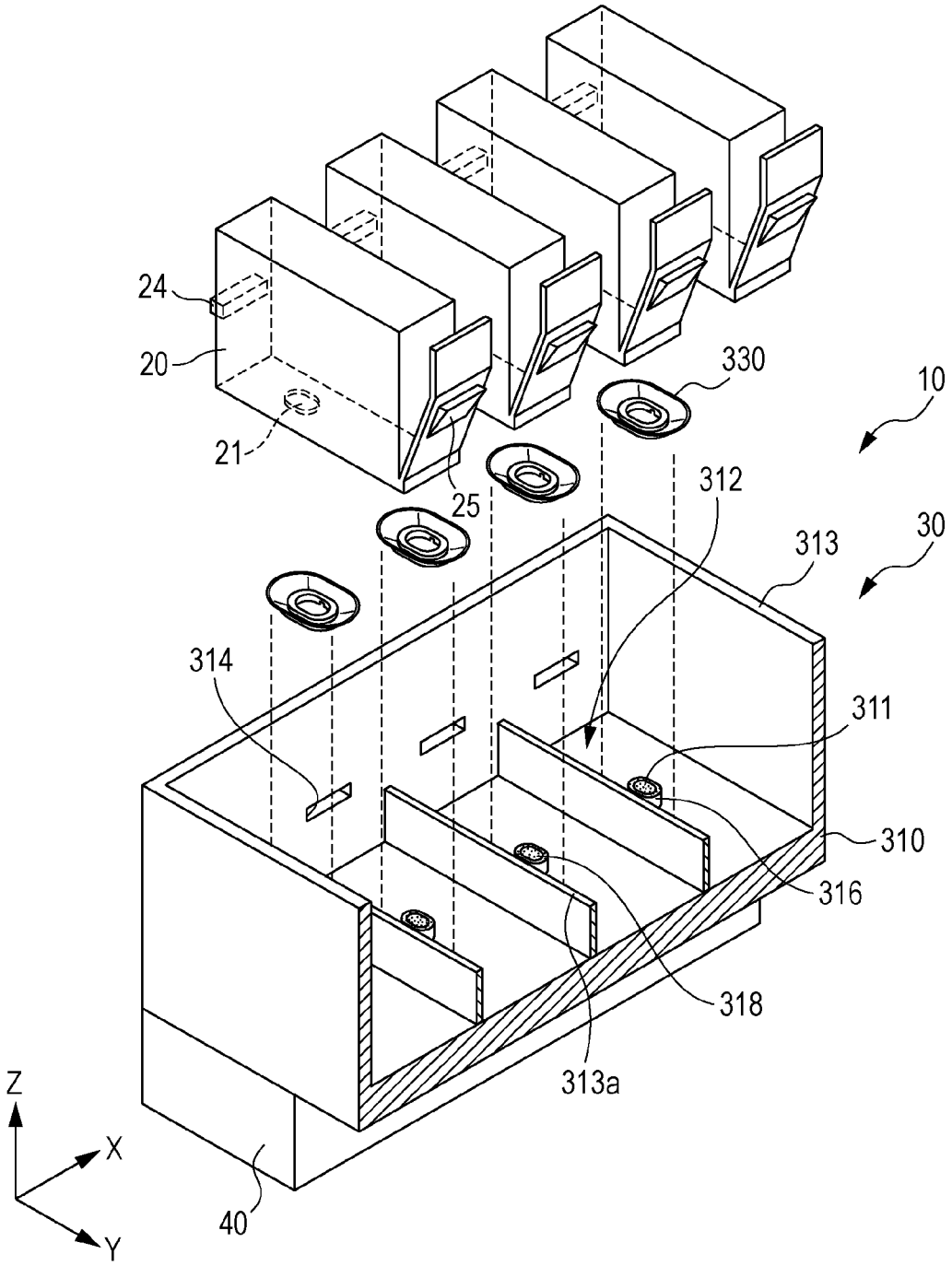
FIG. 1 is an exploded perspective view of a recording head according to a first embodiment.
Figure 2:
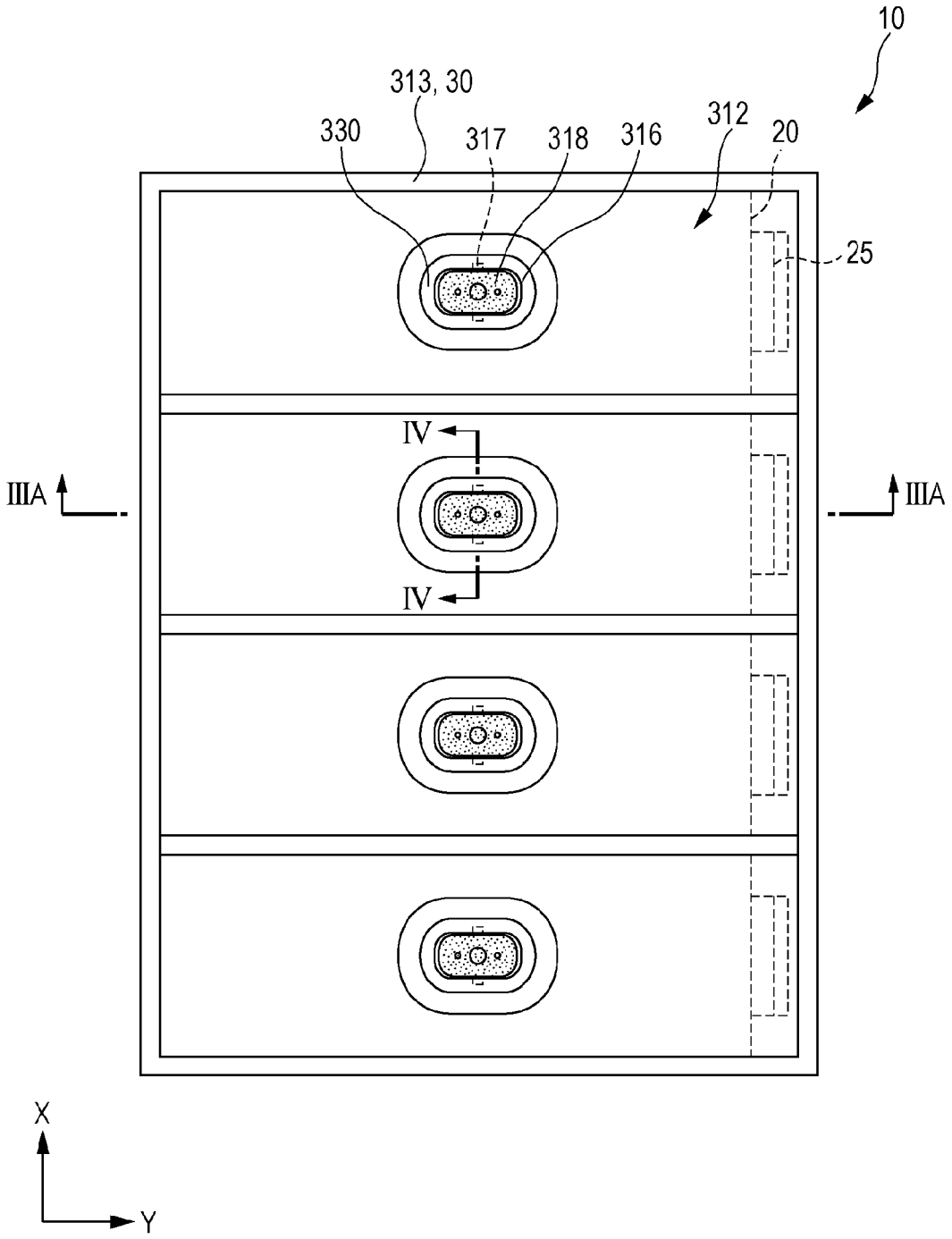
FIG. 2 is a plane view of the recording head according to the first embodiment.
Figure 3A:
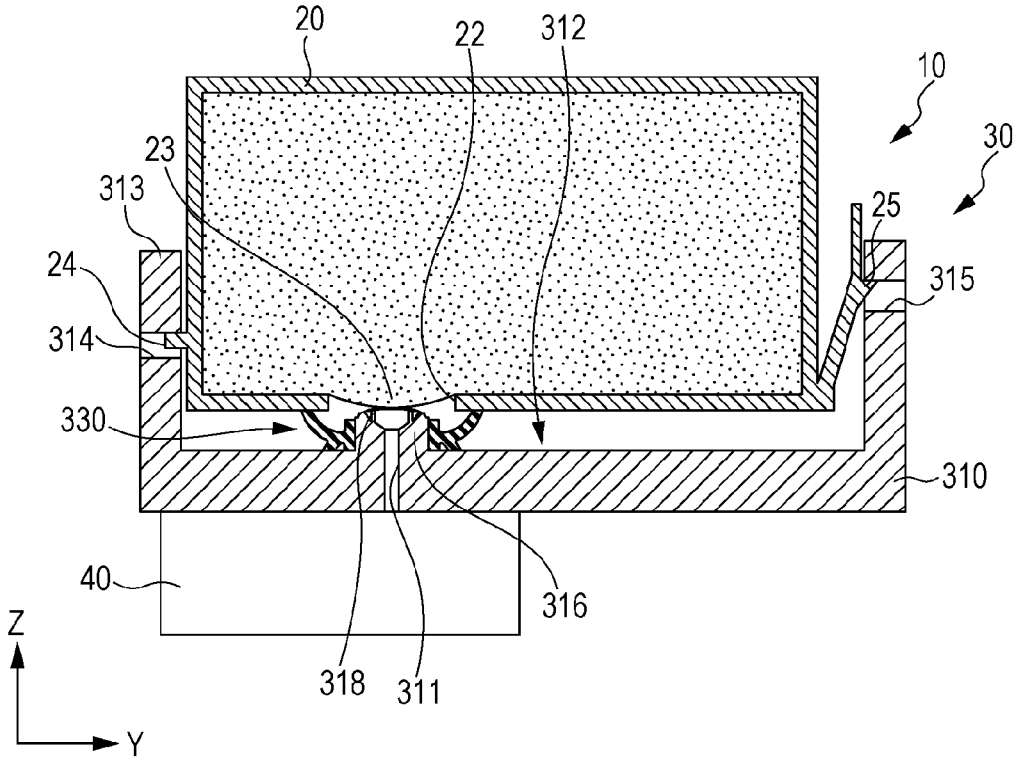
FIGS. 3A and 3B are cross-sectional views of the recording head according to the first embodiment.
Figure 3B:
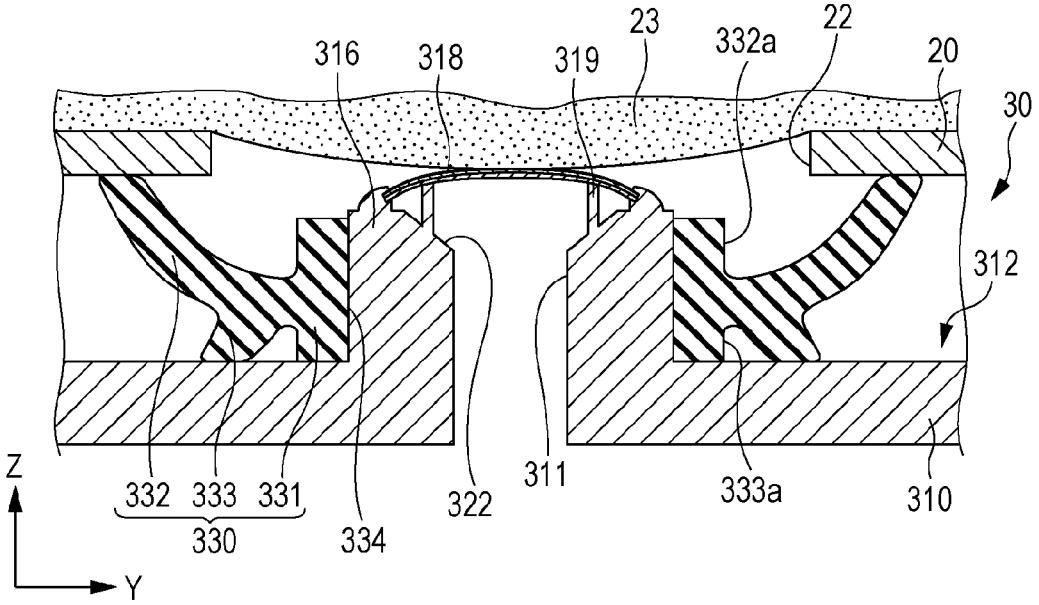
Figure 4:
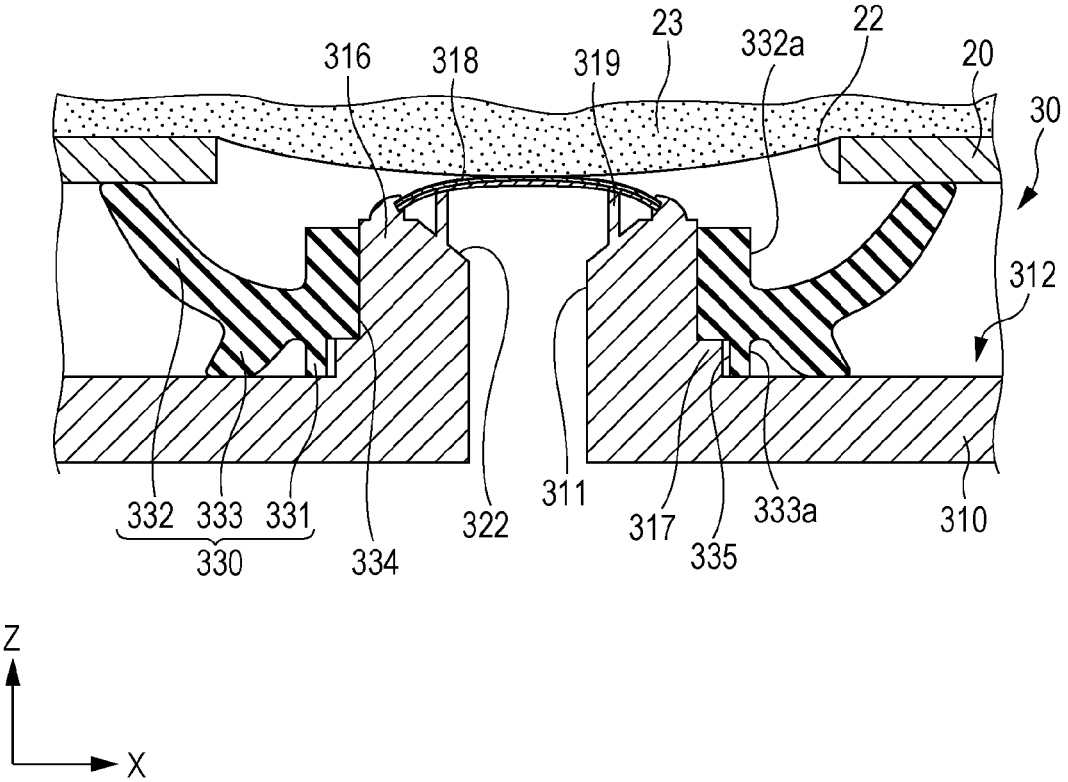
FIG. 4 is a cross-sectional view of the recording head according to the first embodiment.

FIG. 1 is an exploded perspective view of an ink jet type recording head as a liquid ejecting head according to a first embodiment of the invention, FIG. 2 is a plane view of the ink jet type recording head, FIGS. 3A and 3B are cross-sectional views respectively taken along line IIIA-IIIA and line IIIB-IIIB of FIG. 2, and FIG. 4 is a cross-sectional view taken along line IV-IV of FIG. 2.

As illustrated in the drawings, an ink jet type recording head 10 of the embodiment includes a flow path member 30, to which an ink cartridge 20 is detachably provided as a liquid supplying unit for storing ink as liquid, and a head main body 40 that is fixed to the flow path member 30.

The flow path member 30 includes a flow-path member main body 310, and a sealing member 330 that is provided on the flow-path member main body 310.

The flow-path member main body 310 is provided with a liquid supplying path 311, the inside of which ink as liquid passes through, and a cartridge mounting portion 312, on one surface of which the ink cartridge 20 is mounted, where the liquid supplying path 311 is opened. In the embodiment, four ink cartridges 20 are mounted on the cartridge mounting portion 312. Further, in the embodiment, a parallel-arranging direction of the ink cartridges 20 mounted on the cartridge mounting portion 312 of the flow-path member main body 310 is referred to as a first direction X.

The cartridge mounting portion 312 is surrounded by wall portions 313, and first engaging holes 314 and second engaging holes 315 that penetrate the wall portion in a thickness direction are provided on a pair of wall portions 313 that face each other, among the wall portions 313. The first engaging holes 314 and the second engaging holes 315 of the embodiment are provided on the wall portions 313 that face each other in a second direction Y orthogonal to the first direction X.

The ink cartridge 20 is fixed to the cartridge mounting portion 312 by engaging a first claw 24 and a second claw 25 (the details thereof will be described below) of the ink cartridge 20 with the first engaging hole 314 and the second engaging hole 315.

In the embodiment, since four ink cartridges 20 are mounted on the cartridge mounting portion 312, partition plates 313*a* are provided between the ink cartridges 20. That is, three partition plates 313*a* are arranged in parallel in the first direction X, and an interval between the adjacent partition plates 313*a* in the first direction X and an interval between the partition plate 313*a* and the wall portion 313 are set to be an interval in which the ink cartridge 20 can be inserted.

An attaching portion 316 that cylindrically protrudes in a third direction Z orthogonal to the first direction X and the second direction Y is provided on the cartridge mounting portion 312 of the flow-path member main body 310. In the embodiment, since four ink cartridges 20 are fixed to the cartridge mounting portion 312, the attaching portions 316 are provided as the same number of the ink cartridges 20, that is, four attaching portions 316 are provided. Since four ink cartridges 20 are arranged to be fixed to the cartridge mounting portion 312 in parallel in the first direction X, four attaching portions 316 are arranged in parallel in the first direction X. In the embodiment, four attaching portions 316 are arranged so that the positions in the second direction Y are the same, but it is not particularly limited thereto. Four attaching portions 316 may be arranged so that the positions in the second direction Y are different from each other. Accordingly, it is possible to achieve size reduction without a plurality of liquid supplying paths 311 interfering with each other.

When the attaching portion 316 is viewed from the third direction Z as a mounting direction of the ink cartridge 20 in a plan view, the outer shape thereof is a so-called rectangular shape with round corners in which both end portions in the longitudinal direction have a semicircle shape with a rectangular shape as a base. Further, the shape of the attaching portion 316 is not limited to the rectangular shape with round corners and may be an ellipse shape or a shape similar to an ellipse shape, that is, an egg shape or an oval shape. In the embodiment, an ellipse shape, a rectangular shape with round corners similar to an ellipse shape, an egg shape, and an oval are referred to as an oval shape. The shape of the attaching portion 316 is not limited to the oval shape and may be a polygonal shape such as a rectangular shape. In any shape, when the attaching portion 316 is viewed from the third direction Z in a plan view, the outer shape preferably has a longitudinal direction and a short direction. Accordingly, the thickness of an insertion hole 334 of the sealing member 330, which will be described below, is defined by the outer shape, and thus is approximately uniform so that the deviation of the deformation of the sealing member 330 can be suppressed. In the embodiment, the attaching portion 316 is arranged such that the longitudinal direction is the same as the direction of a line connecting the first engaging hole 314 and the second engaging hole 315, that is, the second direction Y, and the short direction is the first direction X as the parallel-arranging direction of the attaching portion 316.

A convex portion 317, which is inserted in a concave portion 335 of sealing member 330 (which will be described below), is provided on the outer circumference of the attaching portion 316. In the embodiment, the convex portion 317 which protrudes toward the first direction X is provided on each of both sides of the attaching portion 316 in the first direction X that is the short direction thereof. That is, two convex portions in total are provided on one attaching portion 316. Further, in the embodiment, the protruding amount of the convex portion 317 from the bottom surface of the cartridge mounting portion 312 toward the third direction Z is smaller than the protruding amount of the attaching portion 316. In the embodiment, two convex portions 317 in total are provided on both sides of the attaching portion 316 in the first direction X, but the number of convex portions 317 and the positions thereof are not limited thereto. For example, the convex portions 317 may be provided on both sides of the attaching portion 316 in the second direction Y. Further, four convex portions 317 in total may be provided by providing the convex portions on both sides of the attaching portion 316 in the first direction X and the second direction Y. However, when viewed from the third direction Z in a plan view, it is preferable for the attaching portion 316 including the convex portions 317 to be formed with linear symmetry so that a line along the first direction X, which is the short direction, passing through the center of the attaching portion 316 and a line along the second direction Y, which is the longitudinal direction, are regarded as symmetrical axes. Accordingly, when mounting the sealing member 330 on the outer circumference of the attaching portion 316, the sealing member 330 may be attached by being rotated at 180 degrees, and thus the process of attaching the sealing member 330 can be simplified. In addition, for example, if only one convex portion 317 is provided on the attaching portion 316, and only one concave portion 335 is provided on the sealing member 330, only one attachment position of the sealing member 330 exists where the convex portion 317 and the concave portion 335 fit with each other. Accordingly, there is a problem in that the sealing member 330 may be attached to the attaching portion 316 in a wrong direction, and thus there is a concern that a sealing defect may occur by attachment in the wrong direction. Although the sealing member 330 can be attached by being rotated at 180 degrees even when only one convex portion 317 is provided on attaching portion 316 as long as two concave portions 335 are provided on the sealing member 330, it is not preferable because the contact area is decreased due to the concave portion 335 which does not fit with the convex portion 317, and there is an disadvantage in that ink is accumulated in the concave portion 335.

In addition, it is preferable for the corner portion of the convex portion 317 in the third direction Z to be subjected to chamfering. In this manner, when mounting the sealing member 330 on the attaching portion 316, the sealing member 330 is unlikely to be engaged with the corner portion, and thus it is possible to easily mount sealing member 330. The chamfering is not limited to that of the corner portion of the convex portion 317, and the end surface of the convex portion 317 in the third direction Z may be provided to be inclined toward the protruding direction in the first direction X.

In this manner, it is possible to suppress the increase in size of the cartridge mounting portion 312 in the second direction Y by providing the convex portions 317 on both sides of the attaching portion 316 in the first direction X, which is the short direction. In other words, if the convex portions 317 are provided on both sides of the attaching portion 316 in the second direction Y, which is the longitudinal direction, it is difficult to secure sufficient space between the attaching portion 316 and the wall portion 313 of the attaching portion 316, and therefore there is a concern that it is necessary to increase the size of the cartridge mounting portion 312 in the second direction Y. In the embodiment, the interval between the adjacent attaching portions 316 in the first direction X can be sufficiently secured by providing the convex portions 317 on both sides of the attaching portion 316 in the first direction X, which is the short direction, and therefore the convex portions 317 of the adjacent attaching portions 316 do not interfere with each other. Accordingly, it is possible to suppress the increase in size in the first direction X.

The liquid supplying path 311, which is opened on the tip surface of the attaching portion, is provided on the attaching portion 316 and a filter 318, which covers the opening of the liquid supplying path 311, is provided on the tip surface where the liquid supplying path 311 is opened.

The filter 318 is for removing foreign substances or bubbles contained in ink, which is liquid, and is provided with a plurality of micropores. As the filter 318, for example, a sheet-shaped filter formed with a plurality of micropores by finely weaving or knitting fiber such as metal or resin, or a filter in which a plurality of micropores penetrate a plate-shaped member such as metal or resin may be used. Further, non-woven fabric may be used for the filter 318 and the material of the filter is not particularly limited. In addition, the filter 318 may be configured of a single layer or may be configured of a multilayer in which a plurality of layers are laminated.

The filter 318 is fixed to the tip surface of the attaching portion 316, that is, an opening surface on which the liquid supplying path 311 is opened. The method of fixing the filter 318 to the attaching portion 316 is not particularly limited, and adhesion by adhesive or welding can be used. In the embodiment, the filter 318 is fixed to the attaching portion 316 by welding. In this manner, the micropores of the filter 318 are not filled with adhesive, and thus it is possible to suppress the reduction of an effective area of the filter 318 compared to a case of adhesion by adhesive. The filter 318 fixed to the attaching portion 316 is provided such that the center portion of the filter is gently curved to be a convex shape on the surface side opposite to the tip surface of the attaching portion 316. That is, the filter 318 is provided such that the peripheral portion thereof is fixed to the tip surface of the attaching portion 316 and the center portion thereof protrudes toward the ink cartridge 20. In the embodiment, the attaching portion 316 is provided with projection portions 319 that protrude toward the filter 318, and the peripheral portion of the filter 318 is welded to the attaching portion 316 in a state where the projection portions 319 are in contact with the filter 318, thereby providing the filter 318 so that the center portion of the filter is deformed to be a convex shape. That is, the tip of the projection portion 319 is provided to protrude toward the ink cartridge 20 more than the tip surface of the attaching portion 316. Two projection portions 319 in total are respectively provided on both sides of the attaching portion with the liquid supplying path 311 interposed therebetween. As long as the projection portion 319 causes the filter 318 to be deformed to be a convex shape, the number or the position of the projection portion is not particularly limited. Of course, the peripheral portion may be fixed to the attaching portion 316 by deforming the filter 318 to be a convex shape without providing the projection portion 319. The filter 318 is provided such that the center portion is made to be a convex shape toward the ink cartridge 20, and therefore it is possible to suppress the reduction of an effective area of the filter 318 by suppressing a bubble remaining between the filter 318 and a supplying portion 23 when the filter 318 is in a liquid-plane contact with the supplying portion 23 of the ink cartridge 20.

The liquid supplying path 311 is provided with a buffer chamber 322 downstream from the filter 318. The buffer chamber 322 has a wider opening than that of the liquid supplying path 311 on the side of the head main body 40. In addition, the bottom surface of the buffer chamber 322, that is, a surface opposite to the filter 318, is formed to be a tapered surface so as to be gradually deeper toward the liquid supplying path 311. The projection portion 319 described above is provided on the bottom surface of the buffer chamber 322.

It is possible to suppress gelation or adhesion of ink, which results from the thickening of ink directly below the filter 318 by moisture evaporated from the filter 318, by providing the buffer chamber 322 having a large volume on a portion downstream from the filter 318. That is, if an ink amount stored in a portion downstream from the filter 318 is small, the ink stored in a portion downstream from the filter 318 is thickened in a short period of time by moisture evaporated from the filter 318. In particular, in a case where pigment ink is used as ink, gelation or adhesion of the pigment ink occurs in a short period of time due to the thickening thereof. In the embodiment, since the ink amount stored in a portion downstream from the filter 318 can be increased by providing the buffer chamber 322 on a portion downstream from the filter 318, even if moisture is evaporated via the filter 318, it is possible to suppress the ink stored in a portion downstream from the filter 318 from thickening in a short of period of time, and thus it is possible to make a time until gelation or adhesion occurs longer.

The sealing member 330 is mounted on the outer circumference of the attaching portion 316 where the filter 318 is provided.

Figure 5A:
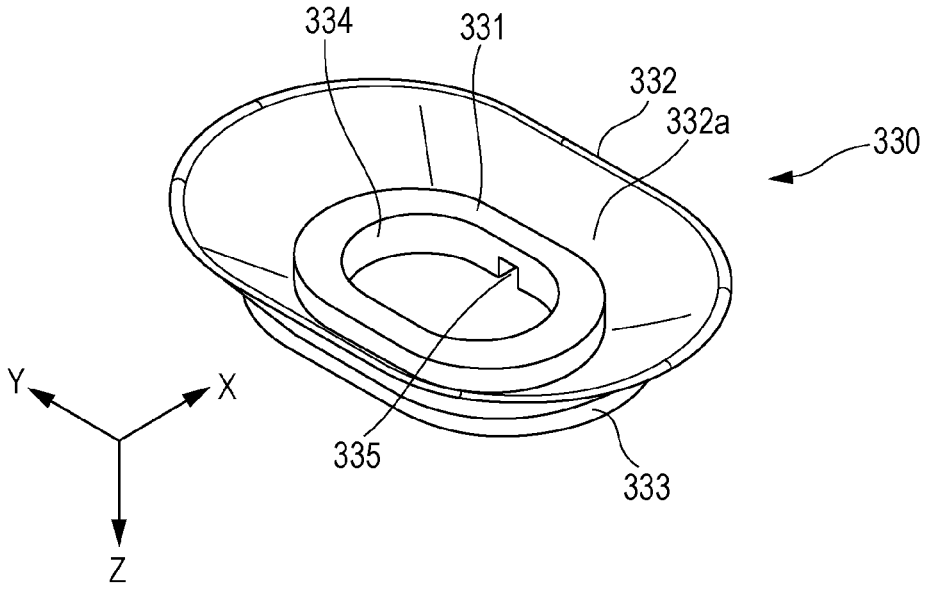
FIGS. 5A and 5B are perspective views of a sealing member according to the first embodiment.
Figure 5B:
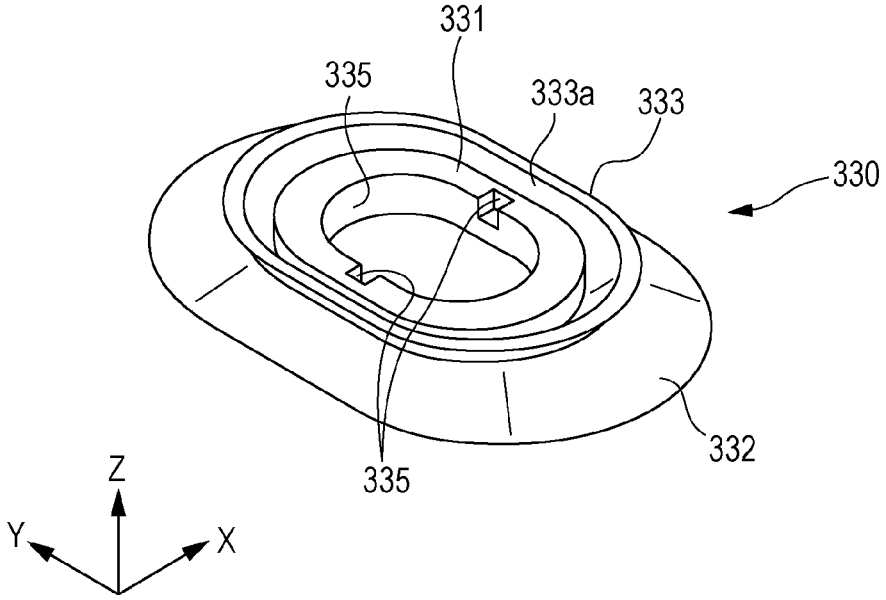

Here, the sealing member 330 will be described in detail with reference to FIGS. 5A and 5B. FIGS. 5A and 5B are perspective views illustrating the sealing member.

As illustrated in the drawings, the sealing member 330 is formed of an elastic material such as a rubber or an elastomer, and includes a base portion 331 having a cylindrical shape, and a first lip 332 and a second lip 333 that are continuously provided on the outer circumference side of the base portion 331 along a circumferential direction.

The base portion 331 has a cylindrical shape in which the insertion hole 334, into the center of which the attaching portion 316 is inserted, is provided. The insertion hole 334 is formed so that the shape of the opening is substantially the same as the shape of the attaching portion 316, that is, in the embodiment, a rectangular shape with round corners. The inner diameter of the insertion hole 334 is provided to be slightly smaller than the inner diameter of the attaching portion 316. Accordingly, when the sealing member 330 is mounted on the outer circumference of the attaching portion 316, the outer circumference of the attaching portion 316 closely adheres to the inner surface of the insertion hole 334.

The first lip 332 is continuously provided on the outer circumference of the base portion 331 along the circumferential direction, and is provided such that the base end portion is integrally fixed to the outer circumference of the base portion 331 and the tip portion has an inner diameter larger than the outer diameter of the base portion 331 and protrudes toward the ink cartridge 20 in the third direction Z. Accordingly, a first groove 332*a* is provided between the tip portion of the first lip 332 on the side of the ink cartridge 20 and the tip portion of the base portion 331 on the side of the ink cartridge 20. Further, in a state in which the ink cartridge 20 is not mounted, the tip portion of the first lip 332 is provided to protrude toward the ink cartridge 20 more than the end face of the base portion 331 on the side of the ink cartridge 20 in the third direction Z. In this manner, the first groove 332*a* is provided between the first lip 332 and the base portion 331, and thus the tip portion of the first lip 332 becomes a free end.

When the ink cartridge 20 is mounted on the cartridge mounting portion 312, the first lip 332 is in contact with a surface where a supplying port 22 of the ink cartridge 20 is provided, and therefore the sealing member 330 and the ink cartridge 20 are connected to each other in a sealed state. Further, when the ink cartridge 20 is mounted on the cartridge mounting portion 312, the end face of the base portion 331 is not in contact with the ink cartridge 20. Accordingly, by causing only the first lip 332 to be in contact with the ink cartridge 20, a contact pressure between the first lip 332 and the ink cartridge 20 is increased, thereby enhancing the sealing force.

In the embodiment, when the sealing member 330 is viewed from a point of the liquid supplying path 311 extending to the ink cartridge 20, that is, viewed from the third direction Z, which is a mounting direction of the ink cartridge 20, in a plan view, the outer shape of the sealing member 330 preferably has a longitudinal direction and a short direction. In the embodiment, when the sealing member 330 is viewed in a plan view, the outer shape thereof is a so-called rectangular shape with round corners in which both end portions in the longitudinal direction have a semicircle shape with a rectangular shape as a base. Further, the outer shape of the sealing member 330 represents the outer shape of a portion effective for sealing when the sealing member is in contact with the ink cartridge 20, and if the sealing member 330 includes the first lip 332 of the embodiment, the outer shape of the sealing member is the outer shape of the first lip 332. In the embodiment, the outer shape of the base portion 331 is substantially the same as that of the first lip 332, and the protruding amount of the first lip 332 from the base portion 331 is substantially the same along the circumferential direction. In this manner, the deviation of the deformation of the first lip 332 is suppressed, and thus it is possible to cause the sealing member to be in close contact with the ink cartridge 20 uniformly along the circumferential direction. Further, the outer shape of the sealing member 330 is not limited to the rectangular shape with round corners and may be an ellipse shape or a shape similar to an ellipse shape, that is, an egg shape or an oval shape. In the embodiment, an ellipse shape, a rectangular shape with round corners similar to an ellipse shape, an egg shape, and an oval are referred to as an oval shape. The shape of the sealing member 330 is not limited to the oval shape and may be a polygonal shape such as a rectangular shape. In any shape, when the sealing member 330 is viewed from the third direction Z in a plan view, the outer shape thereof preferably has a longitudinal direction and a short direction.

The second lip 333 is continuously provided on the outer circumference of the base portion 331 along the circumferential direction, and is provided such that the base end portion is integrally fixed to the outer circumference of the base portion 331, and the tip portion has an inner diameter larger than the outer diameter of the base portion 331 and protrudes toward the bottom surface of the cartridge mounting portion 312 in the third direction Z. Accordingly, a second groove 333*a* is provided between the tip portion of the second lip 333 on the side of the cartridge mounting portion 312 and the base portion 331, and thus the tip portion of the second lip 333 becomes a free end.

Since the protruding tip portion of the second lip 333 is in contact with the bottom surface of the cartridge mounting portion 312, the sealing member 330 and the flow-path member main body 310 are connected to each other in a sealed state. Further, in the embodiment, the sealing member 330 and the flow-path member main body 310 are sealed by the contact between the end face of the base portion 331 in the third direction Z and the bottom surface of the cartridge mounting portion 312. That is, the sealing member 330 and the flow-path member main body 310 are doubly sealed at two regions of the base portion 331 and the second lip 333. Accordingly, it is possible to suppress the leakage of ink by reliably performing the sealing between the sealing member 330 and the flow-path member main body 310.

In the inner surface of the insertion hole 334 of the base portion 331 of the sealing member 330, the concave portion 335 in which the convex portion 317 of the attaching portion 316 is inserted is provided. In the embodiment, since the convex portion 317 is provided on each of both sides of the attaching portion 316 in the first direction X, the concave portion 335 is provided on each of both sides of the insertion hole 334 in the first direction X. In the embodiment, the concave portion 335 is provided without passing through the base portion 331 in the first direction X as the thickness direction, that is, without passing through the second groove 333*a*. Accordingly, it is possible to perform the sealing at the region where the base portion 331 is in contact with the cartridge mounting portion 312. Of course, the concave portion 335 may be provided to pass through the base portion 331 in the first direction X as the thickness direction. That is, the concave portion 335 is provided to pass through the base portion in the first direction X, and the sealing member 330 and the cartridge mounting portion 312 may be sealed by only the second lip 333.

In the embodiment, the concave portion 335 is provided only in the base portion 331 on the side of the cartridge mounting portion 312 in the third direction Z such that the concave portion is opened to an end portion on the side of the cartridge mounting portion 312 and is not opened to an end portion on the side opposite to the cartridge mounting portion 312. Therefore, although the details are described below, in the third direction Z, the inner surface of the insertion hole 334 of the base portion 331 closely adheres to the outer surface of the attaching portion 316 along the circumferential direction, on the end portion side opposite to the end portion where the concave portion 335 of the base portion 331 is provided. Accordingly, the sealing member 330 and flow-path member main body 310 are sealed by the inner surface of the insertion hole 334 of the base portion 331 and the outer surface of the attaching portion 316. In this manner, in the embodiment, the sealing member 330 and the flow-path member main body 310 can be sealed at a region where the inner surface of the insertion hole 334 of the base portion 331 closely adheres to the outer surface of the attaching portion 316; a region where the end portion of the sealing member 330 in the third direction Z closely adheres to the cartridge mounting portion 312; and a region where the second lip 333 adheres to the cartridge mounting portion 312. Thus, it is possible to suppress the leakage of ink by reliably performing the sealing between the sealing member 330 and the flow-path member main body 310. Of course, the concave portion 335 may be continuously provided on the base portion 331 along the third direction Z, that is, may be provided to be opened to both of the end portions of the base portion 331 in the third direction Z.

The sealing member 330, in which the concave portion 335 is provided, is press-fitted into the outer circumference of the attaching portion 316. At this time, the convex portion 317 provided on the attaching portion 316 is inserted in the concave portion 335 provided on the sealing member 330, and thus the position of the sealing member 330 in the rotating direction with respect to the attaching portion 316 is defined with reference to the attaching portion 316 as the center in the first direction X and the in-plane direction of the second direction Y. That is, since the concave portion of the sealing member 330 and the convex portion of the attaching portion 316 fit with each other to cause the sealing member 330 to be mounted on the outer circumference of the attaching portion 316, it is possible to easily perform the positioning when the sealing member 330 is mounted on the attaching portion 316. Accordingly, it is possible to simplify fitting work of the sealing member 330. In a case where the convex portion 317 and the concave portion 335 are not provided on the attaching portion 316 and the sealing member 330, since the sealing member 330 is formed of an elastic material, the sealing member is easily deviated. Further, it is difficult to determine whether the positioning of the sealing member 330 in the rotating direction with respect to the attaching portion 316 is performed with a high accuracy by only visually recognizing the position of the sealing member 330 in the rotating direction with respect to the attaching portion 316. If the position of the sealing member 330 in the rotating direction with respect to the attaching portion 316 deviates, the deviation of the deformation of the sealing member 330 occurs when mounting the ink cartridge 20, and therefore there is a concern that the sealing defect may occur and ink may leak. In the embodiment, the convex portion 317 of the attaching portion 316 is fitted in the concave portion 335 of the sealing member 330, and therefore it is possible to perform the positioning of the sealing member 330 in the rotating direction with respect to the attaching portion 316 with high accuracy, without depending on visual recognition. Therefore it is possible to suppress the sealing defect or the leakage of ink due to the positional deviation of the sealing member 330 in the rotating direction with respect to the attaching portion 316.

In addition, the sealing member 330 press-fitted into the outer circumference of the attaching portion 316 fits with the convex portion 317 of the attaching portion 316, and thus the movement in the rotating direction with respect to the attaching portion 316 is regulated. That is, the convex portion 317 is in contact with the wall surface of the concave portion 335, and thus the movement of the sealing member 330 in the rotating direction with respect to the attaching portion 316 is regulated. In this manner, the movement of the sealing member 330 in the rotating direction with respect to the attaching portion 316 is regulated, and when the ink cartridge 20 is mounted on the cartridge mounting portion 312, the deviation of deformation of the sealing member 330 is suppressed, thereby suppressing the leakage of ink due to the sealing defect of the sealing member 330. In a case where the convex portion 317 and the concave portion 335 are not provided on the attaching portion 316 and the sealing member 330, since the sealing member 330 is formed of an elastic material, the positional deviation in the rotating direction may occur due to an external force such as vibration or a load at the time of mounting the ink cartridge 20. In the embodiment, since the positional deviation of the sealing member 330 in the rotating direction is suppressed even when an external force such as vibration or a load at the time of mounting the ink cartridge 20 is applied, it is possible to suppress the leakage of ink.

In addition, the concave portion 335 of the sealing member 330 is made to fit with the convex portion 317 of the attaching portion 316, and thus the contact area between the attaching portion 316 and the sealing member 330 can be increased. Further, in addition to the increase of the contact area, since the convex portion 317 of the attaching portion 316 contacts the concave portion 335 of the sealing member 330 in a surface perpendicular to the circumferential direction of the outer circumference of the attaching portion 316, it is possible to improve adhesiveness and fixing force by the anchor effect. Accordingly, it is possible to suppress the leakage of ink from a space between the sealing member 330 and the flow-path member main body 310.

In the embodiment, the sealing member 330 is provided with the first lip 332, and the tip portion of the first lip 332 is in contact with the ink cartridge 20. Accordingly, the base portion 331 provided with the concave portion 335 and the tip portion of the first lip 332, which is in contact with the ink cartridge 20, are arranged by being separated from each other by the first groove 332*a*. Therefore, even if the base portion 331 is deviated to be deformed, the influence of providing the concave portion 335 on the first lip 332 is reduced by providing the concave portion 335 to the base portion 331, and thus it is possible to reliably seal the first lip 332 and the ink cartridge 20. In a case where the end face of the base portion 331 is in contact with the ink cartridge 20 without providing the first lip 332, the load is not uniformly applied to the base portion 331 due to the providing of the concave portion 335 to the base portion 331, and thus the deformation of the base portion may be deviated. Of course, the sealing member 330 may be configured to include only the base portion 331 or only the base portion 331 and the second lip 333 without being provided with the first lip 332.

Similarly, in the embodiment, since the second lip 333 is provided, and thus the sealing member 330 and the flow-path member main body 310 are sealed by the second lip 333, the second lip 333 allows the influence of the concave portion 335 provided in the base portion 331 to be reduced, and thus it is possible to reliably seal the second lip 333 and the flow-path member main body 310. Of course, the sealing member 330 may be configured to include only the base portion 331 or only the base portion 331 and the first lip 332 without being provided with the second lip 333.

In the embodiment, since the convex portion 317 and the concave portion 335 are respectively provided on the outer surface of the attaching portion 316 and the inner surface of the insertion hole 334 of the sealing member 330, it is possible to obtain size reduction of the flow path member 30, in particular, size reduction in the first direction X in which the convex portion 317 is provided by suppressing the size increase of the sealing member 330.

Figure 6A:
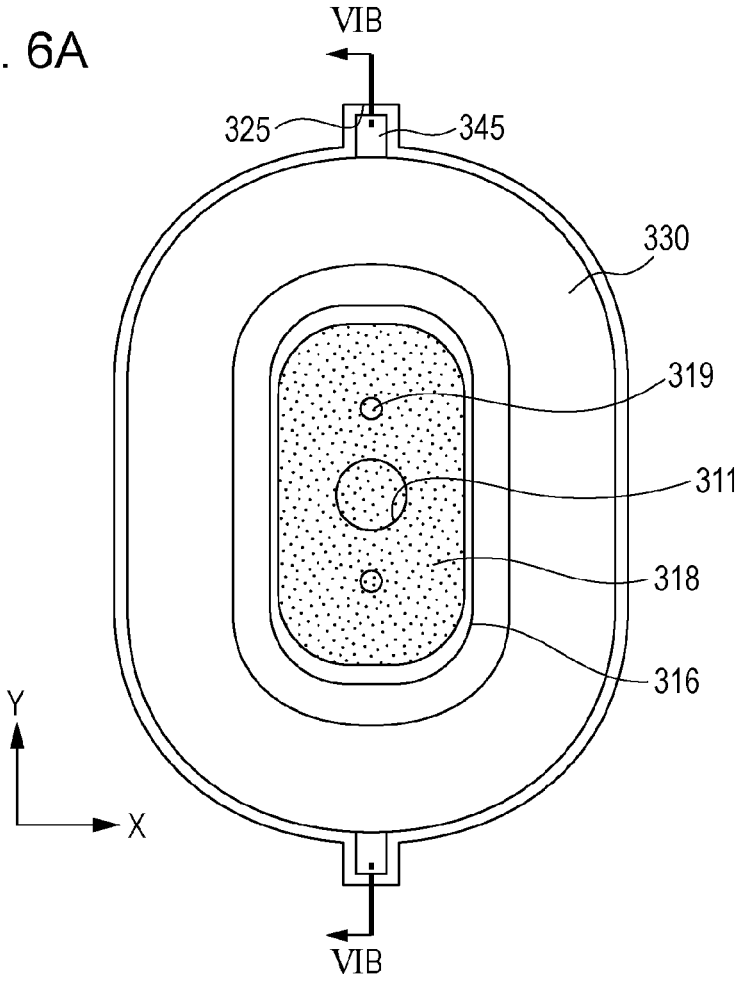
FIGS. 6A and 6B are a plane view and a cross-sectional view of main portions of a recording head according to a comparative example.
Figure 6B:
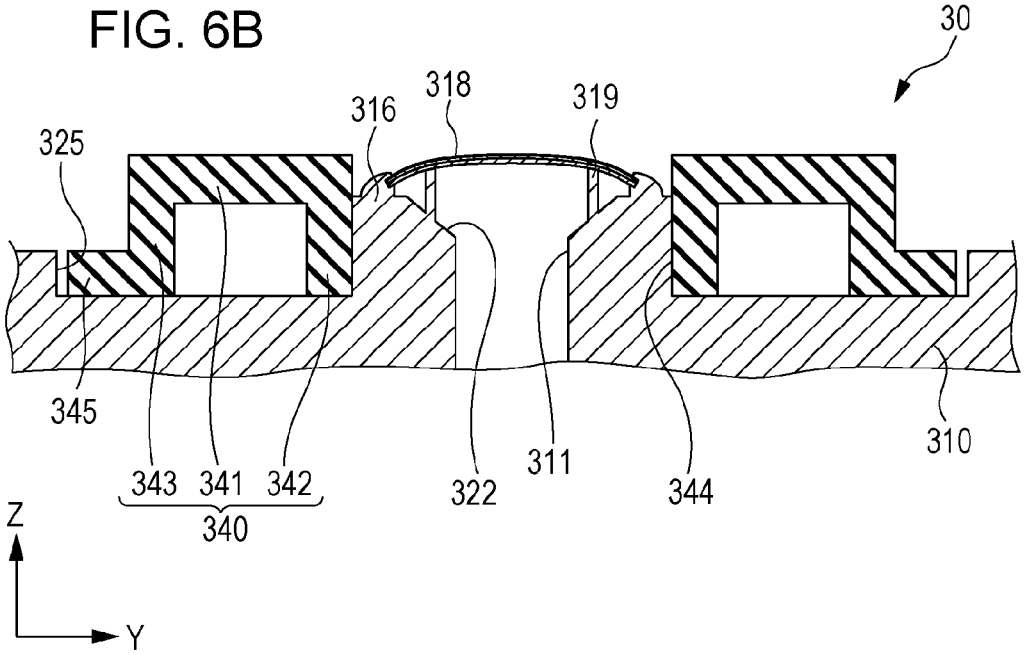

In contrast, as illustrated in FIGS. 6A and 6B, for example, in a case where a convex portion 345 is provided on the outer circumference of a sealing member 340 and a concave portion 325, with which the convex portion 345 fits, is provided on the flow-path member main body 310, it is possible to suppress the positional deviation of the sealing member 340 in the rotating direction with respect to the attaching portion 316, but the size of the sealing member 340 is increased in a direction, in which the convex portion 345 is provided, by the size of the convex portion 345, and therefore the flow path member 30 is increased in size.

In the configuration illustrated in FIGS. 6A and 6B, the sealing member 340 includes a first sealing portion 341 having a flat plate shape, a cylindrical second sealing portion 342 that is opened in an oval, and a cylindrical third sealing portion 343 that is opened in an oval having an inner diameter larger than that of the second sealing portion 342.

The second sealing portion 342 is provided with an insertion hole 344, and has a cylindrical shape to fit with the periphery of the attaching portion 316. In addition, the third sealing portion 343 has a cylindrical shape having an inner diameter larger than that of the second sealing portion 342. The first sealing portion 341 is integrally connected to one end of the second sealing portion 342. Further, the outer circumference of the first sealing portion 341 is integrally connected to one end of the third sealing portion 343. That is, the sealing member 340 is a hollow member that is opened toward the flow-path member main body 310, that is, has a cross-sectional shape of a character C.

Further, the convex portion 345 is provided on the outer circumference of the third sealing portion 343. In the example illustrated in FIGS. 6A and 6B, the convex portion 345 is provided on each of both sides in the second direction Y.

In addition, the flow-path member main body 310 is provided with the concave portion 325 that fits with the convex portion 345 of the sealing member 340, and the convex portion 345 of the sealing member 340 and the concave portion 325 fit with each other. Therefore the positioning of the sealing member 340 in the rotating direction with respect to the attaching portion 316 is performed.

Since the convex portion 345 is provided to protrude on the outer circumference of the sealing member 340, the size of the sealing member 340 is increased in the second direction Y in which the convex portion 345 is provided. Since the convex portion 345 and the concave portion 325 are provided on the outer circumference of the sealing member 340, it is difficult to improve adhesiveness because the contact area between the sealing member 340 and the attaching portion 316 is not increased and the anchor effect with respect to the attaching portion 316 cannot be obtained.

Figure 7A:
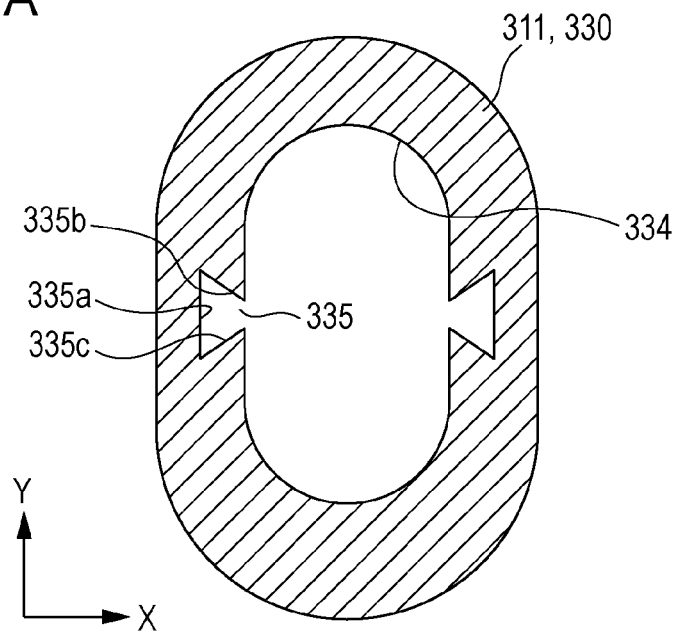
FIGS. 7A and 7B are cross-sectional views illustrating a modification example of the sealing member according to the first embodiment.
Figure 7B:
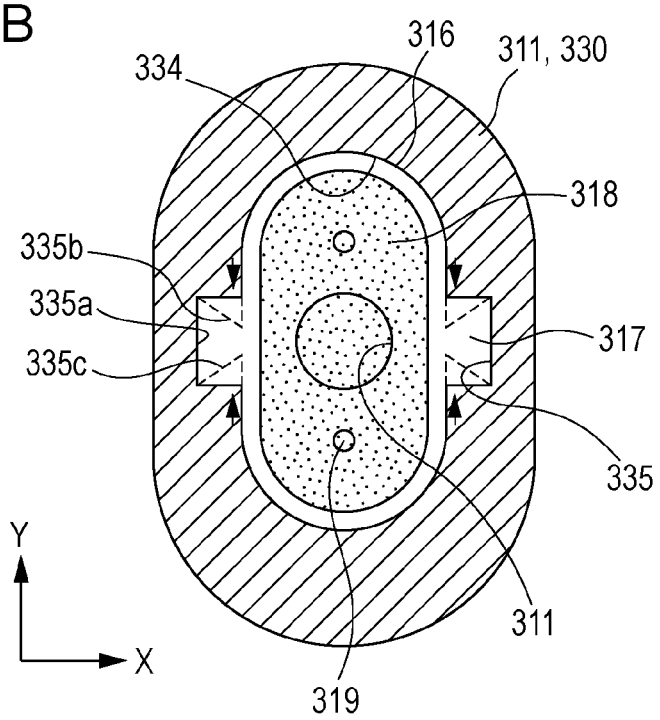

In the embodiment, the concave portion 335 is provided such that the angles formed by the three surfaces corresponding to the convex portion 317 are approximately 90 degrees, but the angles are not particularly limited. Here, the modification example of the concave portion 335 is illustrated in FIGS. 7A and 7B. FIGS. 7A and 7B are cross-sectional views illustrating a modification example of the sealing member.

As illustrated in FIG. 7A, the concave portion 335 may be provided such that the angles formed by the three surfaces corresponding to the convex portion 317 are acute angles. Here, the three surfaces of the concave portion 335 corresponding to the convex portion 317 indicate a first surface 335*a* of the concave portion 335 in the first direction X, and a second surface 335*b* and a third surface 335*c* in the second direction Y. In addition, the angle formed by the first surface 335*a* and the second surface 335*b* is an acute angle, that is, an angle smaller than 90 degrees. Further, the angle formed by the first surface 335*a* and the third surface 335*c* is an acute angle, that is, an angle smaller than 90 degrees. Accordingly, the opening width of the concave portion 335 with respect to the insertion hole 334 is small.

In this manner, the angles formed by the first surface 335*a*, and the second surface 335*b* and the third surface 335*c* of the concave portion 335 are acute angles, and therefore, as illustrated in FIG. 7B, when the concave portion 335 and the convex portion 317 fit with each other, the concave portion 335 can apply a force for interposing the convex portion 317 from both of the sides of the second direction Y, thereby effectively regulating the movement in the rotating direction. That is, it is preferable that the opening width of the concave portion 335 with respect to the insertion hole 334 is smaller than the opening width of the convex portion 317. In this manner, when the convex portion 317 and the concave portion 335 fit with each other, it is easy for the convex portion 317 to be press-fitted to the concave portion 335, and in the opening portion of the concave portion 335 with respect to the insertion hole 334, the concave portion 335 can apply a force for interposing the convex portion 317, thereby effectively regulating the movement in the rotating direction.

Figure 8:
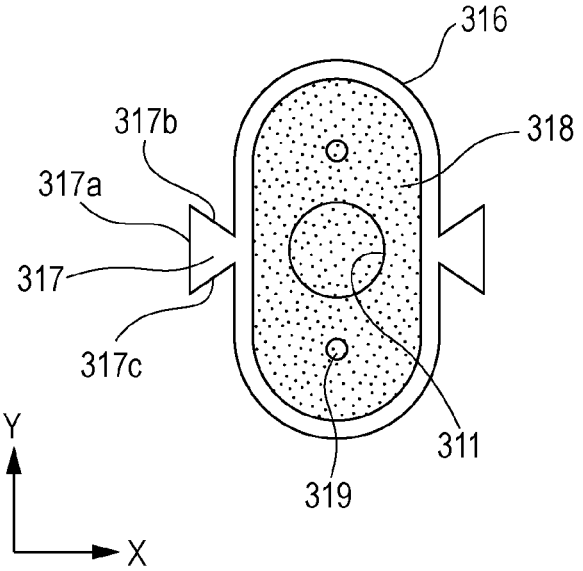
FIG. 8 is a plane view illustrating a modification example of a convex portion according to the first embodiment.

Further, the angles formed by the first surface 335*a*, and the second surface 335*b* and the third surface 335*c* of the concave portion 335 are right angles, and the opening width w1 of the concave portion 335 is smaller than the opening width w2 of the convex portion 317. Therefore the concave portion 335 can apply a force for interposing the convex portion 317 from both of the sides of the second direction Y; however, the contact areas between the two surfaces 335*b* and 335*c* and the convex portion 317 are increased, and thus it is difficult to perform the press-fitting due to friction. In addition, the angles formed by the first surface 335*a*, and the second surface 335*b* and the third surface 335*c* of the concave portion 335 may be obtuse angles, but the force of the concave portion 335 for interposing the convex portion 317 is reduced. Further, in the embodiment, the angles formed by the three surfaces of the convex portion 317 corresponding to the concave portion 335 are right angles; however, the angles are not limited thereto and, for example, the surface of the convex portion 317 may be provided to be inclined with respect to the second surface 335*b* and the third surface 335*c* of the concave portion 335. That is, as illustrated in FIG. 8, angles formed by three surfaces of the convex portion 317, that is, angles formed by a fourth surface 317*a* in the first direction X, and a fifth surface 317*b* and a sixth surface 317*c* that are two surfaces in both sides of the second direction Y with respect to the fourth surface 317*a*, are set to be larger than 270 degrees, and thus the corner portions of the convex portion 317 may be sharpened to have acute angles. In this case, as illustrated in FIGS. 7A and 7B, even if the angles formed by the first surface 335*a*, and the second surface 335*b* and the third surface 335*c* of the concave portion 335 may be right angles or acute angles, when the convex portion 317 and the concave portion 335 fit with each other, it is easy for the convex portion 317 to be press-fitted to the concave portion 335, and the concave portion 335 can apply a force for interposing the convex portion 317, thereby effectively regulating the movement in the rotating direction.

Figure 9:
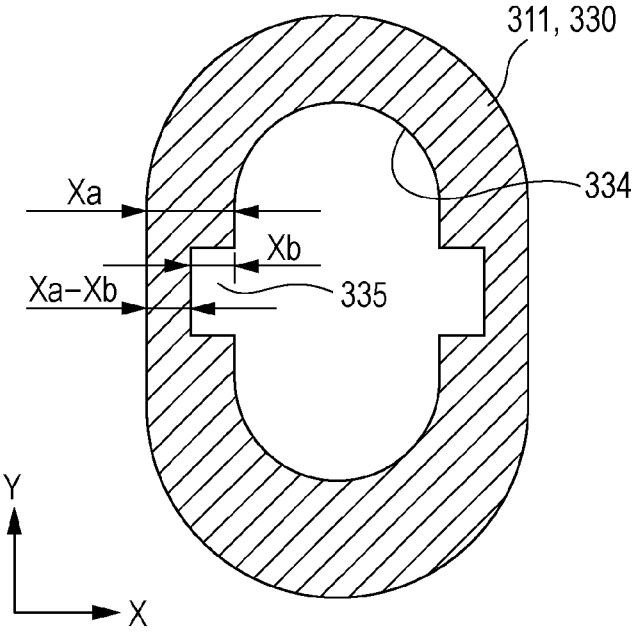
FIG. 9 is a cross-sectional view illustrating the sealing member according to the first embodiment.

In addition, as illustrated in FIG. 9, in the sealing member 330, it is assumed that the width of the portion in which the concave portion 335 is not provided is Xa, the depth of the concave portion 335 in the first direction X is Xb, and the width of the portion in which the concave portion 335 is provided is Xa−Xb. In this case, it is preferable that the ratio (Xb/Xa) of concavity of the concave portion 335 is in a range of 0.35 or more and 0.55 or less. In addition, if the ratio (Xb/Xa) of concavity of the concave portion 335 is too small, an engaging effect of the concave portion 335 with respect to the convex portion 317 is decreased. Further, if the ratio (Xb/Xa) of concavity of the concave portion 335 is too large, the sealing member 350 becomes thin, and is extended when being press-fitted in the attaching portion 316. Therefore there is a concern that the sealing member 350 may be broken, and there is also a concern that the sealing member 350 may be deformed to be distorted by being extremely extended, thereby causing a press-fitting failure. That is, by causing the ratio (Xb/Xa) of concavity of the concave portion 335 to be in a range of 0.35 or more and 0.55 or less, the engaging effect of the concave portion 335 with respect to the convex portion 317 can be improved, and it is possible to suppress the press-fitting failure by suppressing the deformation of the sealing member when the sealing member is press-fitted in the attaching portion 316. The width Xb of the sealing member 330 indicates the width of a portion that is affected when the sealing member is press-fitted in the attaching portion 316, and, in the embodiment, is the thickness when the base portion 331 is viewed from the third direction Z in a plan view.

Here, the ink cartridge 20 detachably mounted to the flow path member 30 will be described with reference to FIGS. 1 and 2.

The ink cartridge 20 has a hollow box shape in which ink (liquid) is stored. Further, a supplying port that requests ink in the ink cartridge 20 to the flow path member 30 is provided on the bottom surface of the ink cartridge 20. In the supplying port 22, the supplying portion 23 is provided as an ink absorber. The supplying portion 23 is in press contact with the filter 318 of the flow path member 30, and is for supplying ink in the ink cartridge 20 to the liquid supplying path 311 of the flow path member 30. As the supplying portion 23, for example, a non-woven fabric and a porous material such as cotton-like pulp, superabsorbent polymer, or urethane foam may be used.

The ink cartridge 20 includes a first engaging claw 24 that is inserted into the first engaging hole 314 provided in the wall portion 313 of the flow-path member main body 310 and a second engaging claw 25 that is provided on a surface opposite to the first engaging claw 24 and is inserted into the second engaging hole 315 provided in the wall portion 313 of the flow-path member main body 310. That is, the first engaging claw 24 and the second engaging claw 25 are respectively provided on both of the surfaces of the ink cartridge 20 in the second direction Y.

The second engaging claw 25 is integrally formed on the ink cartridge 20 such that one end portion is fixed to the side surface of the ink cartridge 20 on the side of the supplying portion 23 and the other end portion becomes a free end.

Accordingly, the second engaging claw 25 is capable of being elastically deformed toward the side surface of the ink cartridge 20.

Figure 10A:
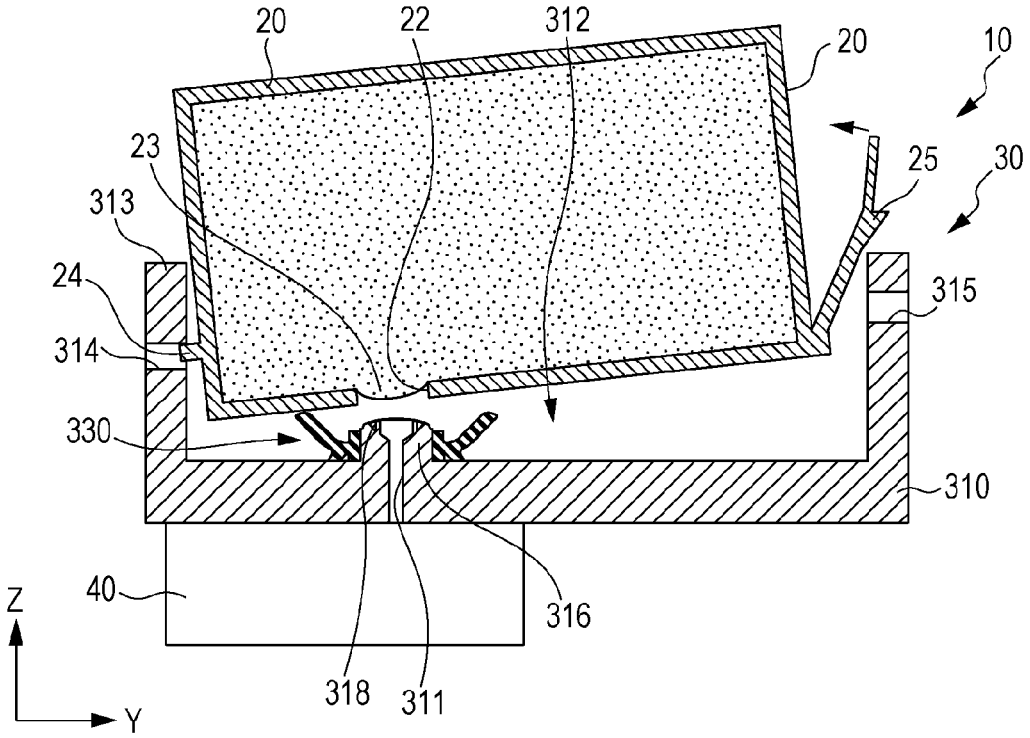
FIGS. 10A and 10B are cross-sectional views illustrating a method of mounting an ink cartridge to a flow path member.
Figure 10B:
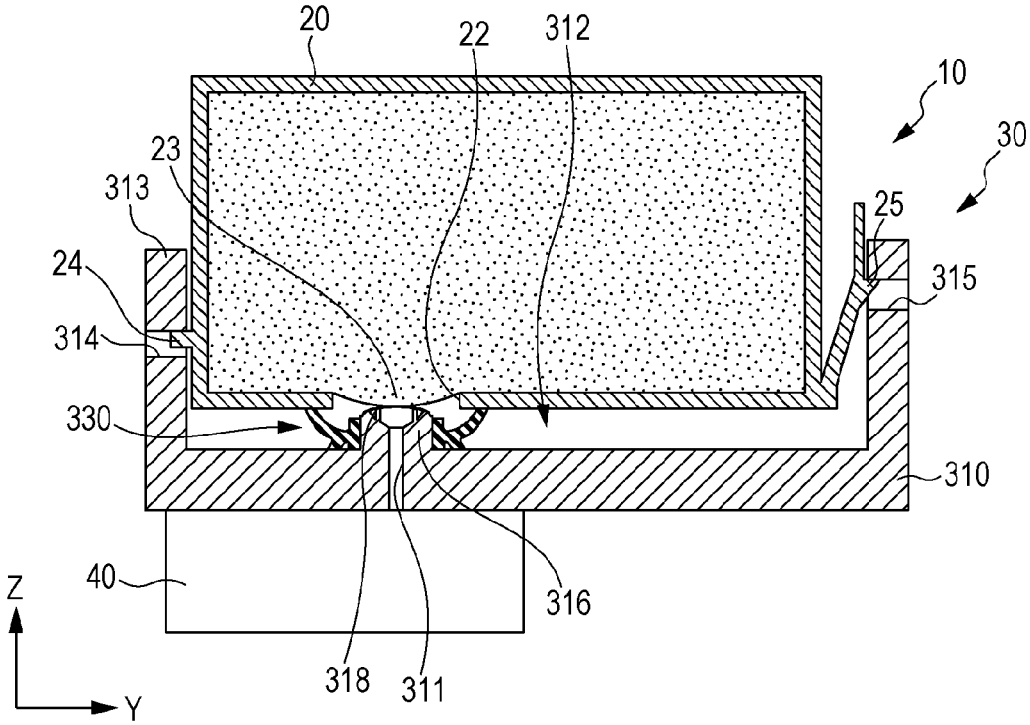

A method of mounting the ink cartridge 20 to the flow path member 30 will be described with reference to FIGS. 10A and 10B. FIGS. 10A and 10B are cross-sectional views illustrating a method of mounting an ink cartridge according to the first embodiment of the invention to a flow path member.

As illustrated in FIG. 10A, firstly, the first engaging claw 24 provided on one surface of the ink cartridge 20 in the second direction Y is obliquely inserted inside the wall portion 313 of the flow-path member main body 310 and then the first engaging claw 24 is inserted into the first engaging hole 314.

As illustrated in FIG. 10B, in a state in which the first engaging claw 24 of the ink cartridge 20 is inserted into the first engaging hole 314, the ink cartridge 20 is rotated with the first engaging claw 24 as a fulcrum, and thus the ink cartridge 20 is inserted inside the wall portion 313. At this time, since the second engaging claw 25 is elastically deformed by being pressed by the wall portion 313 of the flow-path member main body 310, the second engaging claw does not inhibit the ink cartridge 20 from being inserted inside the wall portion 313. Accordingly, the supplying portion 23 and the filter 318 are connected.

The supplying portion 23 is gradually in contact with the filter 318 to be connected by attaching the ink cartridge 20 to flow path member 30 in this manner. At this time, the contact area between the ink cartridge 20 and the sealing member 330 is gradually increased by rotating the ink cartridge in a plane including the second direction Y and the third direction Z, and therefore the load of ink cartridge 20 with respect to the sealing member 330 is gradually increased. However, since the sealing member 330 has an outer shape having a longitudinal direction in the second direction Y, it is possible to suppress the load with respect to the sealing member 330 according to the rotation of the ink cartridge 20 from drastically increasing. That is, if the sealing member 330 has a shape of a perfect circle or is disposed to have an outer shape having a short direction in the second direction Y, the contact area according to the rotation of the ink cartridge 20 is drastically increased, and thus the load thereof is drastically changed. Therefore there is a concern that the deviation of deformation or the positional deviation of the sealing member may occur according to the drastic change of the load.

In the embodiment, by causing the sealing member 330 to have an outer shape having a longitudinal direction in the second direction Y, as the direction in which the area is increased according to the rotation of the ink cartridge 20, it is possible to suppress the load with respect to the sealing member 330 according to the rotation of the ink cartridge 20 from drastically increasing, and to suppress the deviation of deformation or the positional deviation of the sealing member 330 according to the drastic change of the load. Accordingly, it is possible to suppress the sealing defect of the sealing member 330, and to suppress the leakage of ink.

The head main body 40 is fixed to a surface of the flow path member 30 opposite to the cartridge mounting portion 312.

The head main body 40 is provided with a liquid ejecting surface, in which a nozzle for ejecting an ink droplet as liquid is opened, on the side opposite to the surface to which the flow path member 30 is fixed. In addition, the inside (not illustrated) of the head main body 40 is configured by a liquid flow path that communicates with the nozzle and the flow path of the flow path member 30, and a pressure generating unit that causes the pressure of the ink in the liquid flow path to be changed. As the pressure generating unit, for example, a unit which changes the volume of the liquid flow path according to the deformation of a piezoelectric actuator having a piezoelectric material exhibiting an electromechanical converting function and causes the pressure of ink in the liquid flow path to be changed, thereby ejecting ink droplets from a nozzle; a unit in which a heating element is disposed in the liquid flow path and which ejects ink droplets from a nozzle by bubbles generated by the heat of the heating element; and a so-called electrostatic actuator that causes electrostatic force to be generated between a vibration plate and an electrode and causes the vibration plate to be deformed by the electrostatic force, thereby ejecting ink droplets from a nozzle, may be used.

In the ink jet type recording head 10, ink is supplied from the ink cartridge 20 to the head main body 40 through the flow path member 30, and ink droplets are ejected from a nozzle by causing the pressure generating unit to change the pressure of ink in the liquid flow path.

Another Embodiment

Hereinbefore, an embodiment of the invention has been described, but the specific configuration of the invention is not limited to the embodiment described above.

For example, in the first embodiment described above, the convex portion 317 is provided on the outer circumference of the attaching portion 316 and the concave portion 335 is provided on the inner circumferential surface of the insertion hole 334 of the sealing member 330. However, the invention is not particularly limited thereto, and thus a concave portion may be provided on the outer circumference of the attaching portion 316 and a convex portion may be provided on the inner circumferential surface of the insertion hole 334 of the sealing member 330. In order to provide a concave portion on the outer circumference of the attaching portion 316, a thickness for the concave portion to be formed is required to the attaching portion 316, and when the sealing member 330 is mounted on the outer circumference of the attaching portion 316, the convex portion of the sealing member 330 may interfere with the press-fitting. Accordingly, as in the first embodiment described above, by providing the concave portion 335 on the inner circumferential surface of the insertion hole 334 of the sealing member 330 and providing the convex portion 317 on the outer surface of the attaching portion 316, it is possible to decrease the size of the attaching portion 316, and to improve workability when the sealing member 330 is press-fitted to the attaching portion 316.

In the first embodiment, a configuration in which the attaching portions 316 are arranged in parallel with each other in the first direction X is exemplified, but the invention is not limited thereto. The attaching portions 316 may be arranged in parallel with each other in the second direction Y, or the parallel arrangements in the first direction X and the second direction Y may be mixed. A plurality of the attaching portions 316 may have different sizes, and according to the sizes, the sealing members 330 may have different sizes. Of course, the number of attaching portions 316 is not limited to the number in the first embodiment, and one flow path member 30 may be provided with a plurality of (two or more) attaching portions 316, or one flow path member 30 may be provided with one attaching portion 316.

In the first embodiment, as the sealing member 330, a sealing member that includes the base portion 331, the first lip 332, and the second lip 333 is exemplified, but the sealing member is not limited thereto. For example, as the sealing member 340 of the comparative example in the first embodiment, a sealing member that includes the first sealing portion 341, the second sealing portion 342, and the third sealing portion 343 may be used. Even in a case of using the sealing member 340, similar to the first embodiment, by providing a convex portion to one of the sealing member 340 and the attaching portion 316 and providing a concave portion to the other one, it is possible to obtain the same effects as the first embodiment. Further, the sealing member is not limited to the sealing members 330 and 340, and may be a so-called O-ring of which the cross section is a circle, or a solid member or a hollow member having a polygonal shape of which the cross section is a rectangular shape. As described above, it is preferable that the ratio (Xb/Xa) of concavity of the concave portion is in the range of 0.35 or more and 0.55 or less, the width Xa of the sealing member in which the concave portion is not provided, which is regarded as a basis, indicates the width of a portion that is affected when the sealing member is press-fitted in the attaching portion 316, and, in the case of the sealing member 340, the width Xa is the thickness when the second sealing portion 342 is viewed from the third direction Z in a plan view. In addition, if the sealing member is a solid member, the thickness Xa is a thickness (thickness in a direction in which a concave portion is provided) when the solid member is viewed from the third direction Z in a plan view.

In the first embodiment, a configuration is exemplified in which the outer shape of the attaching portion 316 is an oval shape when the attaching portion is viewed from the third direction Z in a plan view, but the invention is not limited thereto. For example, the outer shape of the attaching portion 316 may be a perfect circle or a polygonal shape. Of course, the opening shape of the insertion hole 334 of the sealing member 330 is not particularly limited and may be a perfect circle or a polygonal shape. In addition, the opening shape of the insertion hole 334 of the sealing member 330 may not be a shape similar to the outer shape of the attaching portion 316. That is, it is not limited to an aspect in which the inner surface of the insertion hole 334 of the sealing member 330 and the outer surface of the attaching portion 316 adhere to each other along the circumferential direction, and for example, a gap between the insertion hole 334 and the attaching portion 316 may be formed along a part of or the entirety of the circumferential direction. In this manner, even if a gap is formed between the insertion hole 334 and the attaching portion 316, by providing the convex portion 317 and the concave portion 335, it is possible to regulate the movement of the sealing member 330 in the rotating direction with the attaching portion 316 as a center. In other words, since the positioning of the sealing member 330 in the rotating direction with respect to the attaching portion 316 is performed by providing the convex portion 317 and the concave portion 335 and the movement in the rotating direction is regulated, it is possible to adopt a configuration in which a gap is provided between the sealing member 330 and the attaching portion 316.

In addition, in the first embodiment, a configuration in which the sealing member 330 has a longitudinal direction and a short direction is exemplified, but the invention is not limited thereto. The outer shape of the sealing member 330 may be a perfect circle or a square.

Figure 11:
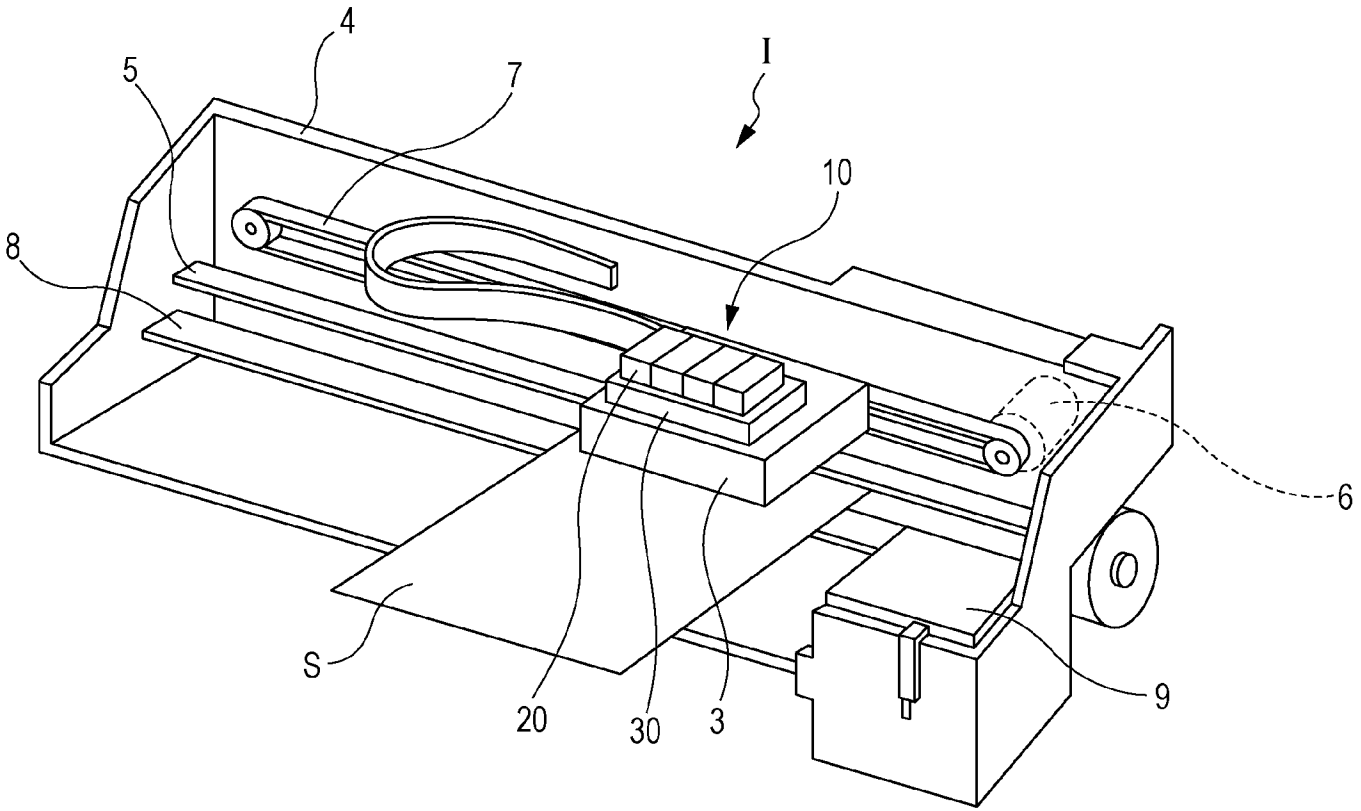
FIG. 11 is a schematic view of a recording apparatus according to an embodiment of the invention.

Further, in the ink jet type recording head 10 of the first embodiment, a part of an ink jet type recording head unit that includes an ink flow path communicating with an ink cartridge or the like is configured to be mounted in an ink jet type recording apparatus. FIG. 11 is a schematic view illustrating an example of the ink jet type recording apparatus.

In an ink jet type recording apparatus I illustrated in FIG. 11, the ink jet type recording head 10 is detachably provided with the ink cartridge 20 configuring an ink supplying unit, and a carriage 3, on which the ink jet type recording head 10 is mounted, is provided to a carriage shaft 5 attached to an apparatus main body 4 to be movable in the axial direction. The ink jet type recording head 10 ejects a black ink composition and a color ink composition.

Further, the carriage 3 on which the ink jet type recording head 10 is mounted is moved along the carriage shaft 5 by transferring driving force of a driving motor 6 to the carriage 3 via a plurality of gears (not illustrated) and a timing belt 7. Meanwhile, the apparatus main body 4 is provided with a transporting roller 8 as a transporting unit, and a recording sheet S as a recording medium such as paper is transported by the transporting roller 8. A transporting unit that transports the recording sheet S is not limited to the transporting roller and may be a belt or a drum.

In the example described above, the ink jet type recording head 10 including the flow path member 30 has been described, but the invention can be applied to an ink jet type recording apparatus in which the flow path member 30 is provided to a portion other than the ink jet type recording head 10. Specifically, in an ink jet type recording apparatus in which an ink tank as a liquid supplying unit in which ink is stored is fixed to the apparatus main body 4 instead of being mounted on the carriage 3, and the ink tank and the head main body 40 are connected via a supplying tube having a tube shape, for example, the flow path member 30 may be provided to a location where the ink tank is installed.

In the ink jet type recording apparatus I, a configuration in which the ink jet type recording head 10 is mounted on the carriage 3 so as to be moved in a main scanning direction is exemplified, but the invention is not limited thereto. For example, the invention may be applied to a so-called line type recording apparatus in which the ink jet type recording head 10 is fixed, and the printing is performed by only moving the recording sheet S such as paper in a sub scanning direction.

Further, the invention is made for methods of manufacturing, widely, general liquid ejecting heads and can be applied to methods of manufacturing a recording head such as various types of ink jet type recording heads used in an image recording apparatus such as a printer; a color-material ejecting head that is used in the manufacturing of a color filter such as a liquid crystal display; an electrode-material ejecting head that is used in the formation of electrode such as an organic EL display or a field emission display (FED); and a bio-organic substance ejecting head that is used in the manufacturing of a biochip.

Further, the invention is not limited to the flow path member mounted in the liquid ejecting head and the liquid ejecting apparatus, and can be applied to a flow path member mounted on devices other than the liquid ejecting head and the liquid ejecting apparatus.

What is claimed is:

1. A flow path member comprising:

a flow-path member main body provided with a liquid supplying path through which liquid is supplied to a head main body that ejects liquid and an attaching portion to which a liquid supplying unit that supplies liquid of the liquid supplying path is attached; and a sealing member provided with an insertion hole into which the attaching portion is inserted, and is interposed between the liquid supplying unit and the attaching portion, wherein a convex portion is provided in any one of the inner surface of the insertion hole and the outer surface of the attaching portion, and a concave portion that fits with the convex portion is provided in the other of the inner surface of the insertion hole and the outer surface of the attaching portion, wherein the flow-path member main body and the sealing member are fitted by causing the convex portion to fit with the concave portion.

2. The flow path member according to claim 1, wherein the sealing member includes a base portion that is provided with the insertion hole, and a first lip that extends from the base portion to the liquid supplying unit to be in contact therewith.

3. The flow path member according to claim 2, wherein the sealing member further includes a second lip that is in contact with the flow-path member main body.

4. A liquid ejecting head comprising the flow path member according claim 3.

5. A liquid ejecting apparatus comprising the flow path member according claim 3.

6. A liquid ejecting head comprising the flow path member according claim 2.

7. A liquid ejecting apparatus comprising the liquid ejecting head according to claim 6.

8. A liquid ejecting apparatus comprising the flow path member according claim 2.

9. The flow path member according to claim 1, wherein the convex portion is provided on the outer surface of the attaching portion, and wherein the concave portion is provided on the inner surface of the insertion hole.

10. A liquid ejecting head comprising the flow path member according claim 9.

11. A liquid ejecting apparatus comprising the flow path member according claim 9.

12. The flow path member according to claim 1, wherein, when the sealing member is viewed from a point of the liquid supplying path extending toward the liquid supplying unit, the outer shape of the sealing member has a longitudinal direction and a short direction.

13. A liquid ejecting head comprising the flow path member according claim 12.

14. A liquid ejecting apparatus comprising the flow path member according claim 12.

15. The flow path member according to claim 1, wherein each of angles formed by three surfaces of the concave portion corresponding to the convex portion is an acute angle.

16. A liquid ejecting head comprising the flow path member according claim 15.

17. A liquid ejecting apparatus comprising the flow path member according claim 15.

18. A liquid ejecting head comprising the flow path member according claim 1.

19. A liquid ejecting apparatus comprising the liquid ejecting head according to claim 18.

20. A liquid ejecting apparatus comprising the flow path member according claim 1.

* * * * *